US011043772B2

(12) United States Patent
Matsumura

(10) Patent No.: US 11,043,772 B2
(45) **Date of Patent: *Jun. 22, 2021**

(54) CONNECTOR WITH CABLE COVER

(71) Applicant: Yazaki Corporation, Tokyo (JP)

(72) Inventor: Kaoru Matsumura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/818,053

(22) Filed: Mar. 13, 2020

(65) Prior Publication Data

US 2020/0303872 A1 Sep. 24, 2020

(30) Foreign Application Priority Data

Mar. 20, 2019 (JP) ..... JP2019-052469

(51) Int. Cl.
*H01R 13/506* (2006.01)
*H01R 13/52* (2006.01)
*H01R 13/10* (2006.01)

(52) U.S. Cl.
CPC ..... *H01R 13/5208* (2013.01); *H01R 13/506* (2013.01); *H01R 13/10* (2013.01); *H01R 13/5227* (2013.01)

(58) Field of Classification Search
CPC ..... H01R 13/5227; H01R 13/5208; H01R 13/10; H01R 13/506
See application file for complete search history.

(56) References Cited

U.S. PATENT DOCUMENTS

| | | | | |
|---|---|---|---|---|
| 8,257,101 | B2 * | 9/2012 | Ichio | H01R 13/5227 439/206 |
| 8,662,910 | B2 * | 3/2014 | Ichio | H01R 13/5227 439/206 |
| 8,827,731 | B2 * | 9/2014 | Sasaki | H01R 13/5227 439/206 |
| 9,337,633 | B2 * | 5/2016 | Suzuki | H01R 13/5227 |
| 9,917,396 | B2 * | 3/2018 | Horiuchi | H01R 13/5227 |
| 10,044,133 | B2 * | 8/2018 | Wittrock | H01R 13/5227 |
| 2013/0078846 | A1 * | 3/2013 | Sasaki | H01R 13/5227 439/374 |

FOREIGN PATENT DOCUMENTS

| | | | | |
|---|---|---|---|---|
| EP | 2595254 | A2 * | 5/2013 | H01R 13/5219 |
| JP | H10-199611 | A | 7/1998 | |
| JP | 2002-025684 | A | 1/2002 | |
| JP | 2006-339114 | A | 12/2006 | |
| WO | 2014/020402 | A1 | 2/2014 | |

* cited by examiner

*Primary Examiner* — Tho D Ta
(74) *Attorney, Agent, or Firm* — Sughrue Mion, PLLC

(57) ABSTRACT

A connector with cable cover includes a housing including a terminal accommodation chamber configured to accommodate a terminal connected to a cable and a rear surface having an opening of the terminal accommodation chamber configured to draw out the cable from the housing; and a cable cover formed in a tubular shape and attached to a side of the rear surface. The housing is provided with a water drain passage communicating from a part of the rear surface positioned below the opening on the rear surface to a rear side of a lower surface of the housing.

2 Claims, 6 Drawing Sheets

CONNECTOR WITH CABLE COVER

CROSS REFERENCE TO RELATED APPLICATION

The present application is based on, and claims priority from Japanese Patent Application No. 2019-052469, filed on Mar. 20, 2019, the entire contents of which are incorporated herein by reference.

TECHNICAL FIELD

The disclosure relates to a connector with cable cover.

RELATED ART

As this type of a connector with cable cover, the connector with cable cover disclosed in JP 2002-25684 A includes a housing having a terminal accommodation chamber in which a terminal connected to a cable is accommodated and a cable is drawn out from a rear surface, and a tubular cable cover attached to the side of the rear surface of the housing. The cable cover has a tubular cover body and a pair of opening and closing members provided on the cover body via a hinge. The rear side of the inner surface of the pair of opening and closing members is provided with a locking section for locking a bellows-like corrugated tube.

SUMMARY

However, in the conventional connector with cable cover, water coming down from the cable or the corrugated tube collects in a hollow groove of the housing, and the water cannot be removed.

An object of the disclosure is to provide a connector with cable cover capable of draining water to the outside even if the water coming down from a cable or the like is going to enter the housing.

The connector with cable cover according to the present embodiment includes a housing including a terminal accommodation chamber configured to accommodate a terminal connected to a cable and a rear surface having an opening of the terminal accommodation chamber configured to draw out the cable from the housing; and a cable cover formed in a tubular shape and attached to a side of the rear surface. The housing is provided with a water drain passage communicating from a part of the rear surface positioned below the opening on the rear surface to a rear side of a lower surface of the housing.

According to the above configuration, it is possible to provide the connector with cable cover capable of draining water to the outside through the water drain passage even if the water coming down from the cable or the like is going to enter the housing.

DETAILED DESCRIPTION

Various embodiments will be described hereinafter with reference to the accompanying drawings.

A description will hereinafter be given of an embodiment with consultation of drawings.

Figure 1:
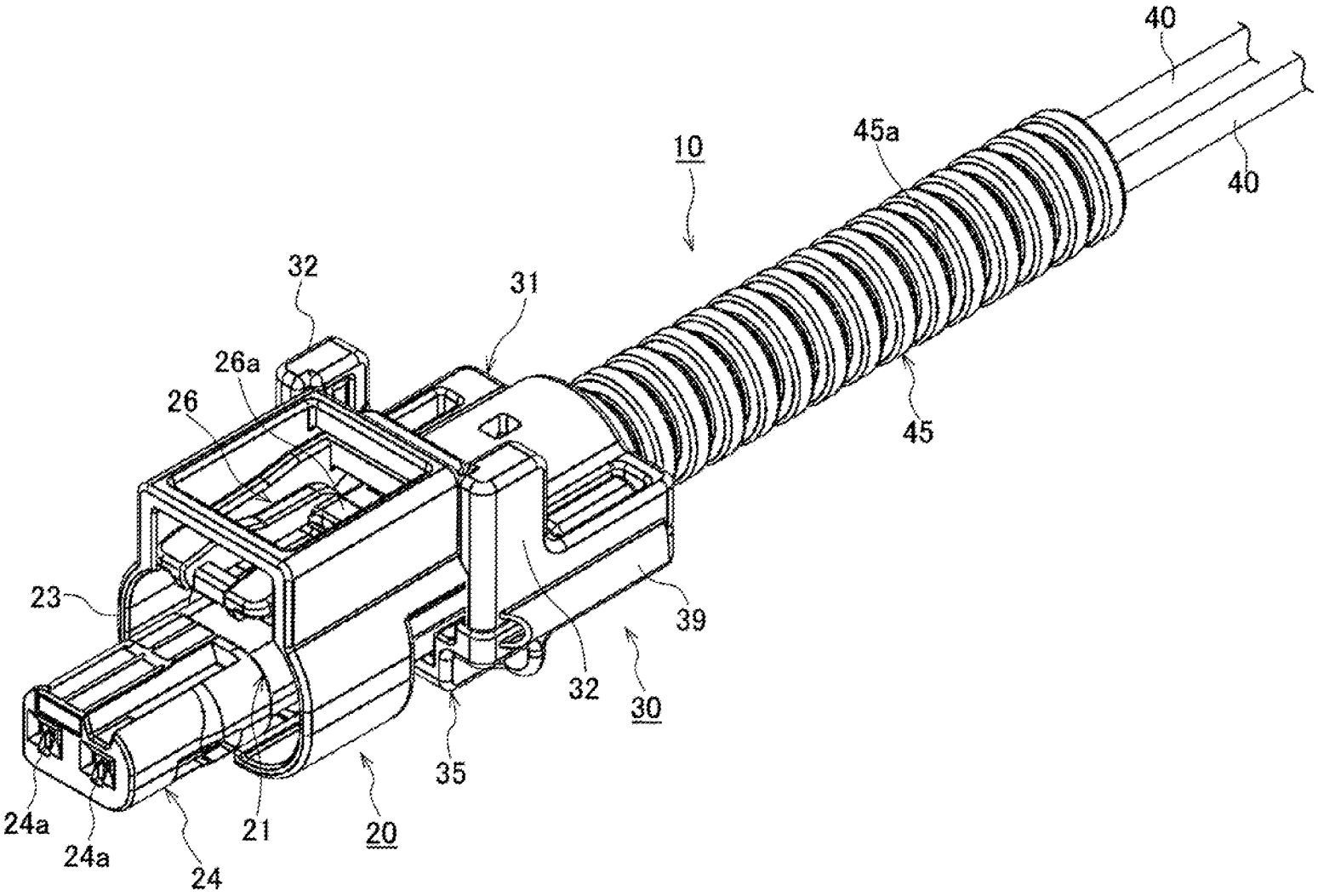
FIG. 1 is a perspective view illustrating a connector with cable cover according to a present embodiment.
Figure 2:
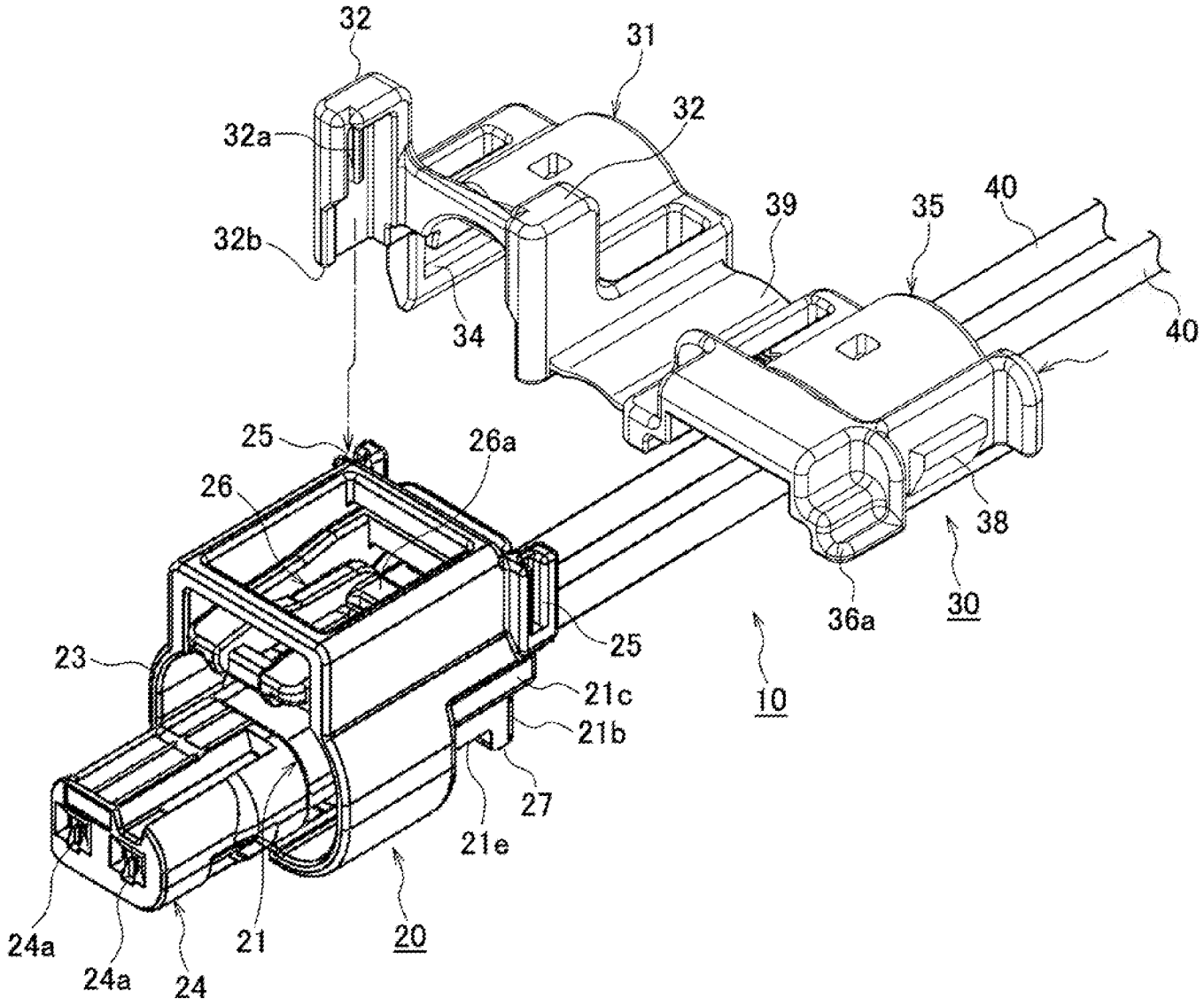
FIG. 2 is a perspective view illustrating a state before the cable cover of the connector with cable cover is attached.
Figure 3:
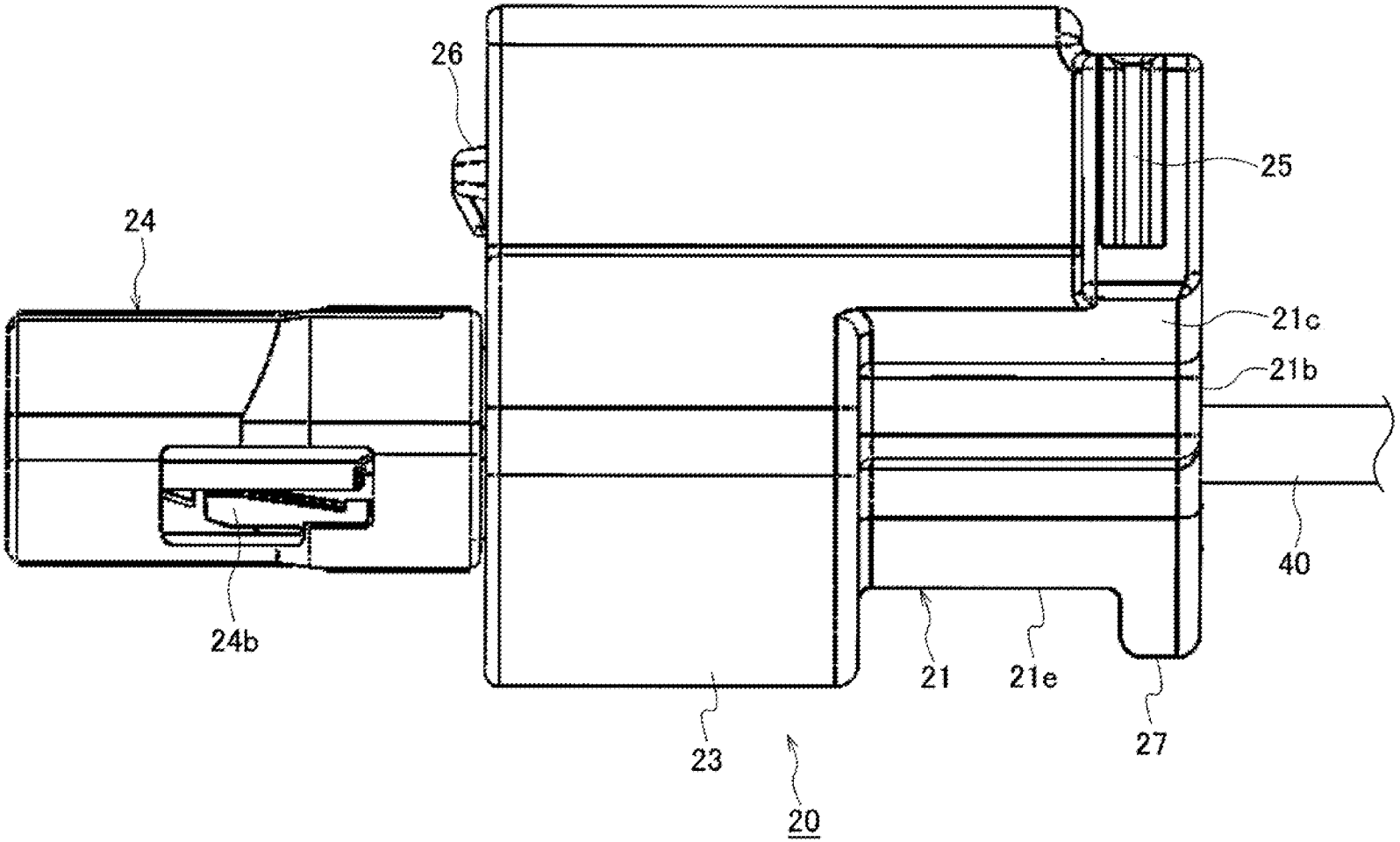
FIG. 3 is a side view of a housing of the connector with cable cover.
Figure 4:
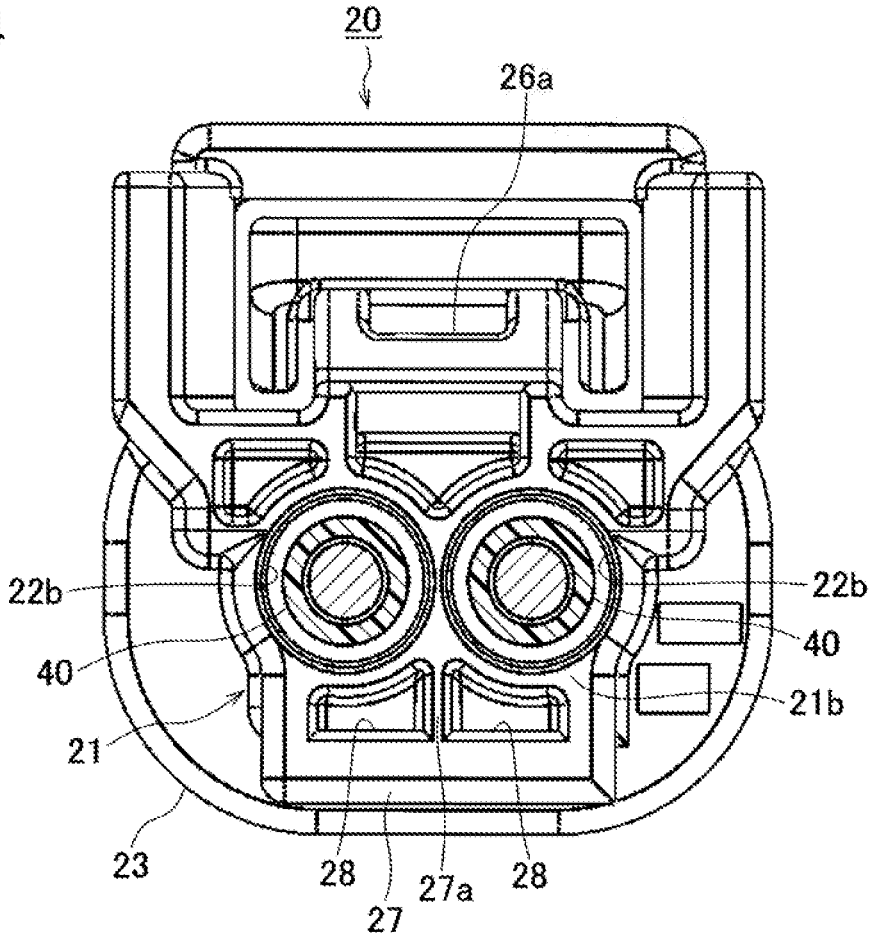
FIG. 4 is a back view of the housing.
Figure 5:
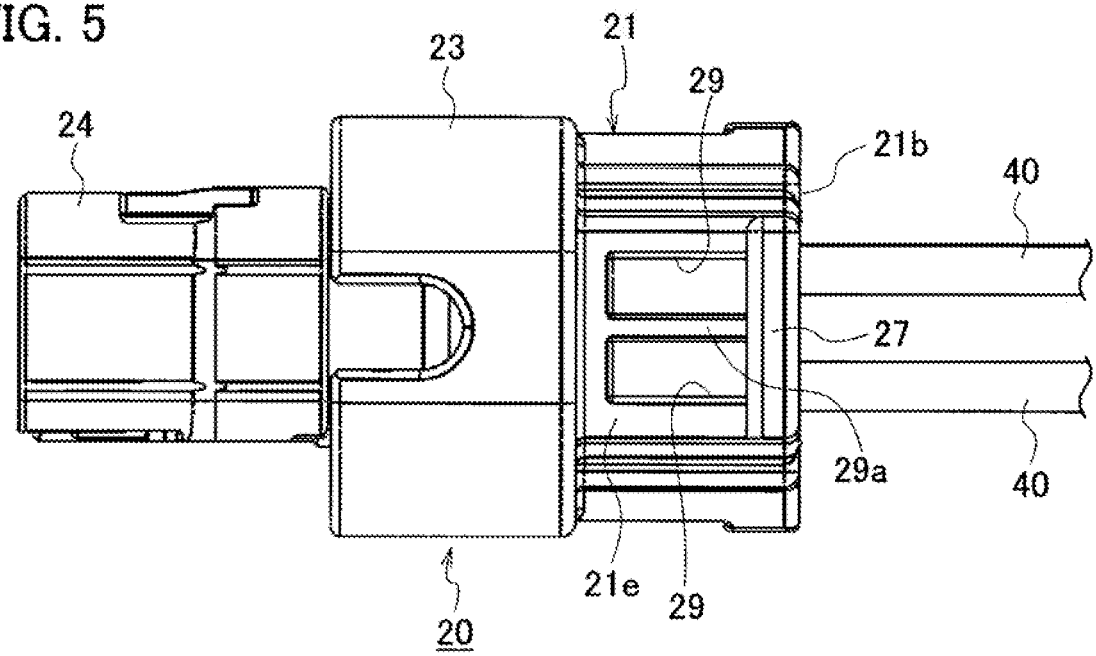
FIG. 5 is a bottom view of the housing.
Figure 6:
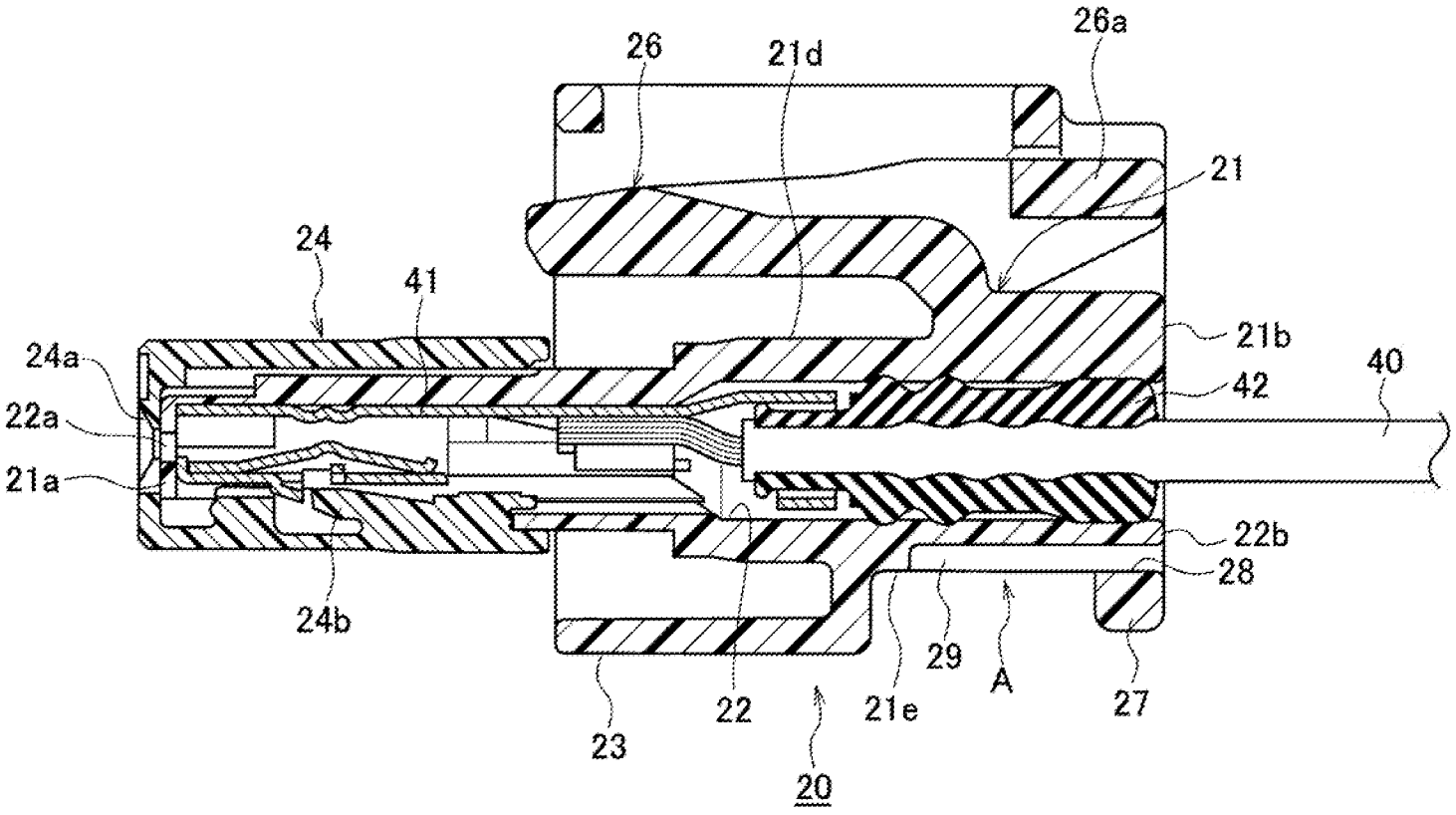
FIG. 6 is a cross-sectional view of the housing.

FIG. 1 is a perspective view illustrating the connector with cable cover according to the present embodiment; FIG. 2 is a perspective view illustrating a state before the cable cover of the connector with cable cover is attached; FIG. 3 is a side view of the housing of the connector with cable cover; FIG. 4 is a back view of the housing; FIG. 5 is a bottom view illustrating the lower surface of the housing; FIG. 6 is a cross-sectional view of the housing; and FIG. 7 is a cross-sectional view of the connector with cable cover.

For convenience of description, a predetermined direction in a connector 10 with cable cover is defined as the longitudinal direction, a predetermined direction orthogonal to the longitudinal direction is defined as the vertical direction, and a direction orthogonal to the longitudinal direction and the vertical direction is defined as the width direction.

Figure 7:
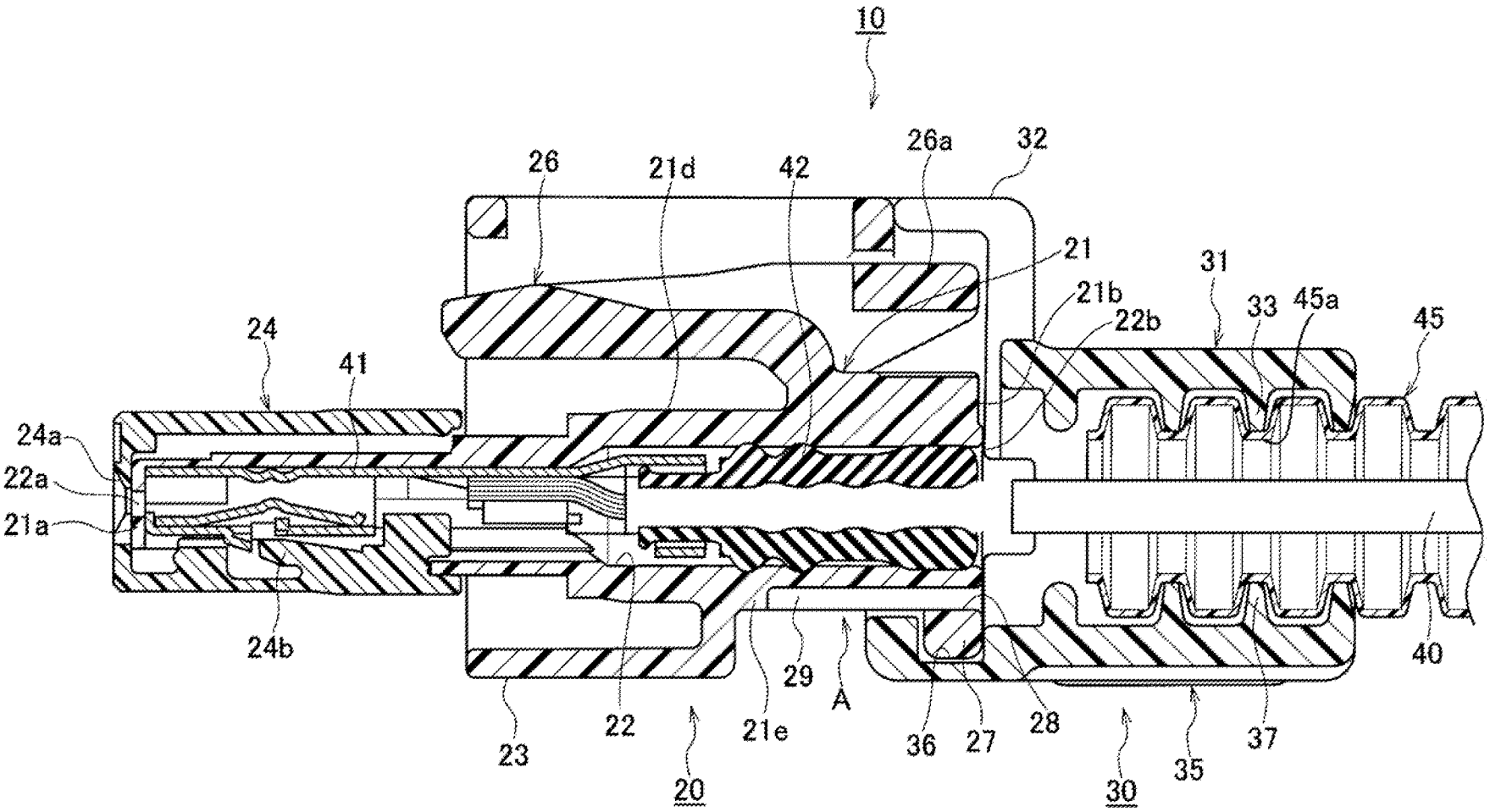
FIG. 7 is a cross-sectional view of the connector with cable cover.

As illustrated in FIGS. 1, 2, and 7, the connector 10 with cable cover includes a synthetic resin female housing (housing) 20 from which a cable 40 is drawn out from a rear surface (back surface) 21*b*, and a synthetic resin tubular cable cover 30 attached to the rear surface 21*b* of the female housing 20. In the present embodiment, the longitudinal direction is a long side of the female housing 20, which is a direction in which the cable 40 to which a female terminal (terminal) is connected is inserted into the female housing 20.

As illustrated in FIGS. 1 to 7, the female housing 20 includes a housing body 21, a hood section 23, and a tubular front holder 24. The housing body 21 has two terminal accommodation chambers 22 in which the female terminal 41 connected to the cable 40 is accommodated. The hood section 23 is formed integrally with the center of the housing body 21 so as to protrude therefrom, and the front surface side and the upper surface side thereof into which a male housing of a male connector of an unillustrated mate is fitted are opened. The tubular front holder 24 is fitted into the front side of the housing body 21, and has a terminal insertion hole 24*a* into which a male terminal of the unillustrated mate is inserted, and a lance 24*b* for locking the female terminal 41.

As illustrated in FIGS. 4, 6, and 7, the terminal accommodation chamber 22 of the housing body 21 accommodates the female terminal 41 connected to the terminal of the cable 40 from a circular opening 22*b* of the terminal accommodation chamber 22 provided on the rear surface 21*b*. The space between each terminal accommodation chamber 22 and the cable 40 is sealed with a rubber plug 42 mounted to the cable 40. A front surface 21*a* of the housing body 21 is formed with a terminal insertion hole 22*a* into which the male terminal of the unillustrated mate is inserted so as to communicate with the terminal accommodation chamber 22.

As illustrated in FIG. 2, the side of the rear end of both side surfaces 21*c* of the housing body 21 provided in the width direction of the housing 20 is formed with a recessed cover locking groove 25 as a cover locking section. A ceiling surface 21*d* of the housing body 21 is provided with a lock arm 26 for locking with the male housing of the mate into a fitted state. An operation end 26*a* of the lock arm 26 is provided on the rear side of the upper opening of the hood section 23.

Furthermore, the rear end of a lower surface 21*e* of the housing 20 is provided with a cover attachment projection 27 as a cover attachment section. As illustrated in FIGS. 4, 6, and 7, the cover attachment projection 27 is provided with a pair of water drain holes 28 below the respective openings 22*b* of the two terminal accommodation chambers 22 so as to penetrate through the cover attachment projection 27. A reinforcement rib 27*a* is formed between the pair of water drain holes 28. That is, the water drain holes 28 are formed in a divided manner with the reinforcement rib 27*a* as a boundary. The rear side of the lower surface 21*e* of the housing 20 is formed with a pair of rectangular, recessed water drain recesses 29 communicating with the pair of water drain holes 28. That is, the water drain recesses 29 on the lower surface 21*e* of the housing body 21 are also formed in a divided manner with a partition wall 29*a*, corresponding to the reinforcement rib 27*a*, as a boundary. The water drain hole 28 of the cover attachment projection 27 and the water drain recess 29 of the lower surface 21*e* of the housing body constitute a water drain passage A. The water drain passage A is formed so as to communicate from below each opening 22*b* of the two terminal accommodation chambers 22 on the rear surface 21*b* of the housing body 21 to the rear side of the lower surface 21*e*.

As illustrated in FIGS. 1, 2, and 7, the cable cover 30 has a substantially semicylindrical body cover 31, a substantially semicylindrical lid cover 35, and a hinge 39. The substantially semicylindrical body cover 31 is attached to the recessed cover locking groove 25 on the both side surfaces 21*c* of the housing body 21. The substantially semicylindrical lid cover 35 is attached to the cover attachment projection 27 on the lower surface 21*e* of the housing 20 in a tubular state where the substantially semicylindrical lid cover 35 is integrated with the body cover 31, and the substantially semicylindrical lid cover 35 covers the front end side of a corrugated tube 45 through which the cable 40 penetrates. The hinge 39 is provided between the body cover 31 and the lid cover 35.

The front side of the body cover 31 is formed integrally with a pair of attachment sections 32 so as to vertically extend in parallel. The inside of each attachment section 32 is provided with a protruding housing locking projections 32*a* as a housing locking section fitted into the recessed cover locking groove 25 of the housing body 21. An inner surface of the body cover 31 is provided with a protruding part 33 locked to a bellows-like recessed part 45*a* of the corrugated tube 45. Furthermore, the end part of the body cover 31 opposite to the hinge 39 is formed with a lock hole 34.

As illustrated in FIG. 7, the front side of the inner surface of the lid cover 35 is formed with a recessed housing attachment groove 36 as a housing attachment section fitted into the cover attachment projection 27 of the housing body 21. An inner surface of the lid cover 35 is provided with a protruding part 37 locked to the bellows-like recessed part 45*a* of the corrugated tube 45. Furthermore, as illustrated in FIG. 2, the end part of the lid cover 35 opposite to the hinge 39 is provided with a lock projection 38 locked to the lock hole 34. When the body cover 31 and the lid cover 35 are integrated into a tubular shape, a stepped part 36*a* formed in the front part of the outside of the lid cover 35 is fitted into a notch part 32*b* formed on the side of the lower end of the attachment section 32 on the outside of the body cover 31.

According to the connector 10 with cable cover of the embodiment described above, even if water coming down from the corrugated tube 45 or the cable 40 is going to enter the rear surface 21*b* side of the housing body 21 of the female housing 20, the water is discharged to the outside through the water drain passage A communicating from below the opening 22*b* of the terminal accommodation chamber 22 on the rear surface 21*b* of the housing body 21 to the rear side of the lower surface 21*e*. Thereby, the entry of water from the corrugated tube 45 or the cable 40 can be prevented on the rear surface 21*b* side of the housing body 21.

Furthermore, while the pair of water drain holes 28 are formed in the cover attachment projection 27 of the housing body 21, the pair of water drain holes 28 are formed in a divided manner with the reinforcement rib 27*a* as a boundary and are reinforced by the reinforcement rib 27*a*, and thus, even if the cable cover 30 is pulled in a removal direction, the cover attachment projection 27 is not damaged and the strength of the cover attachment projection 27 is enhanced.

According to the embodiment described above, the two water drain holes of the cover attachment projection and the two recessed water drain recesses on the lower surface of the housing body are formed, but one water drain hole and one water drain recess may be formed.

According to the embodiment described above, the recessed water drain recess on the lower surface of the housing body is formed, but a water drain hole communicating from the lower surface side of the housing body to the water drain hole of the cover attachment projection may be formed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connector with cable cover, comprising:

a housing including a terminal accommodation chamber configured to accommodate a terminal connected to a cable and a rear surface having an opening of the terminal accommodation chamber configured to draw out the cable from the housing; and a cable cover formed in a tubular shape and attached to a side of the rear surface, wherein the housing is provided with a water drain passage communicating from a part of the rear surface positioned below the opening on the rear surface to a rear side of a lower surface of the housing, a rear end of the lower surface is provided with a cover attachment projection configured to attach the cable cover, the water drain passage is formed by a water drain hole formed on the cover attachment projection, and a water drain recess formed on the rear side of the lower surface and communicating with the water drain hole.

2. The connector with cable cover according to claim 1, wherein the housing includes a reinforcement rib separating the water drain hole into a divided manner and further separating the water drain recess into a divided manner.

* * * * *